US005411605A

United States Patent [19]

Omori et al.

[11] Patent Number: 5,411,605

[45] Date of Patent: May 2, 1995

[54] SOFT MAGNETIC STEEL MATERIAL HAVING EXCELLENT DC MAGNETIZATION PROPERTIES AND CORROSION RESISTANCE AND A METHOD OF MANUFACTURING THE SAME

[75] Inventors: Toshimichi Omori; Haruo Suzuki; Tetsuya Sampei; Takahiro Kanero; Masayoshi Nakagawa; Masayoshi Kurihara, all of Tokyo, Japan

[73] Assignee: NKK Corporation, Tokyo, Japan

[21] Appl. No.: 74,834

[22] PCT Filed: Oct. 13, 1992

[86] PCT No.: PCT/JP92/01332

§ 371 Date: Jun. 11, 1993

§ 102(e) Date: Jun. 11, 1993

[87] PCT Pub. No.: WO93/08312

PCT Pub. Date: Apr. 19, 1993

[30] Foreign Application Priority Data

Oct. 14, 1991 [JP] Japan ..... 3-291934

[51] Int. Cl.[6] ..... C22C 38/06; C21D 1/74

[52] U.S. Cl. ..... 148/113; 148/122; 148/307; 148/309; 420/103

[58] Field of Search ..... 148/113, 122, 307, 309; 420/103

[56] References Cited

FOREIGN PATENT DOCUMENTS

| | | |
|---|---|---|
| 36-1614 | 3/1961 | Japan . |
| 60-106947 | 6/1985 | Japan . |
| 60-197883 | 10/1985 | Japan . |
| 61-127817 | 6/1986 | Japan . |
| 63-109114 | 5/1988 | Japan . |
| 63-45443 | 9/1988 | Japan . |
| 1-283343 | 11/1989 | Japan . |
| 2-4918 | 1/1990 | Japan . |
| 2-4919 | 1/1990 | Japan . |
| 2-4920 | 1/1990 | Japan . |
| 2-4921 | 1/1990 | Japan . |
| 2-4922 | 1/1990 | Japan . |
| 2-4923 | 1/1990 | Japan . |
| 2-8323 | 1/1990 | Japan . |
| 2-8324 | 1/1990 | Japan . |
| 2-8325 | 1/1990 | Japan . |
| 2-8326 | 1/1990 | Japan . |
| 2-213421 | 8/1990 | Japan . |
| 2-259047 | 10/1990 | Japan . |
| 2-310345 | 12/1990 | Japan . |
| 3-4606 | 1/1991 | Japan . |
| 3-20447 | 1/1991 | Japan . |
| 3-72028 | 3/1991 | Japan . |
| 3-75314 | 3/1991 | Japan . |
| 3-75315 | 3/1991 | Japan . |
| 3-82715 | 4/1991 | Japan . |
| 3-87313 | 4/1991 | Japan . |
| 3-94046 | 4/1991 | Japan . |
| 3-115546 | 5/1991 | Japan . |
| 3-134140 | 6/1991 | Japan . |
| 3-150313 | 6/1991 | Japan . |

*Primary Examiner*—Scott Kastler
*Assistant Examiner*—Sikyin Ip
*Attorney, Agent, or Firm*—Nields & Lemack

[57] ABSTRACT

This invention is intended for providing a soft magnetic steel material having excellent DC magnetization properties and corrosion resistance, and capable of being manufactured at a low cost, and a method of manufacturing the same.

The soft magnetic steel material of this invention contains 0.8 to 3.5% by weight of soluble aluminum, as well as limited amounts of C, total nitrogen, Si, Mn, P, S and total oxygen, and has an average ferrite crystal diameter of which the minimum has a specific relation to the thickness or diameter of the material. The material has a surface covered densely with aluminum oxide particles having a diameter of 0.01 to 5 microns. It exhibits a coercive force not exceeding 0.4 Oe in the absence of any strain and a magnetic flux density of 15,000 G or more at a magnetomotive force of 25 Oe. The aluminum oxide particles formed on the surface of the material are preferably formed with a density of $1\times10^{12}$ to $1\times10^{16}$ particles, or more preferably $1\times10^{13}$ to $1\times10^{16}$ particles, per square meter to achieve its excellent corrosion resistance.

The material is manufactured by the final heat treatment of a steel material having the composition stated above at a temperature of 850° C. to 1300° C. in an atmosphere having an oxygen partial pressure of $10^{-6}$ to $10^{-2}$ preferably $10^{-6}$ to $10^{-3}$ or more preferably $10^{-5}$ to $10^{-3}$ atmosphere.

6 Claims, 2 Drawing Sheets

SOFT MAGNETIC STEEL MATERIAL HAVING EXCELLENT DC MAGNETIZATION PROPERTIES AND CORROSION RESISTANCE AND A METHOD OF MANUFACTURING THE SAME

TECHNICAL FIELD

This invention relates to a soft magnetic steel material having excellent DC magnetization properties and corrosion resistance and a method of manufacturing the same. More particularly, it is intended for providing a soft magnetic steel material which is excellent in coercive force and magnetic flux density and also in corrosion resistance, and a method of manufacturing the same.

BACKGROUND ART

When a soft magnetic steel material forming a component of a magnetic circuit is employed in a DC magnetic field, and even when in is employed in an AC magnetic field of which frequency is lower than a commercially available frequency, its core-loss property, which is one of the items for its evaluation on AC properties, is of little importance, but it is rather desirable that its coercive force, which is one of the items for its evaluation on DC magnetization properties, be small to, for example, reduce the residual magnetism in the component of the magnetic circuit and ensure the linearity of its performance. The material is also desired to have a high magnetic flux density to provide an efficiently working component of a magnetic circuit.

The arts aimed at the solution of those problems are known from, for example, Japanese Patent Applications laid open under Nos. Hei 3-75314 and Hei 3-20447. They are all intended for improving the DC magnetization properties of soft magnetic steel materials based on pure iron. Those materials have a good level of magnetic flux density owing to the inherently high saturation magnetization of iron, and include some having a low coercive force, too.

None of those arts, however, discloses any measure for ensuring the corrosion resistance of materials. It, therefore, follows that, when any component of a magnetic circuit based on those arts is used for any application calling for corrosion resistance, it is essential to give it surface treatment, such as plating or coating. The addition of a large amount of chromium to steel for imparting to it corrosion resistance comparable to that of stainless steel is known from, for example, Japanese Patent Applications laid open under Nos. Hei 3-150313 and Hei 2-259047. Although it is necessary to add expensive chromium in the amount of 5 to 8% by weight, or even more to impart corrosion resistance to steel, Hei 3-150313 shows by way of an example that an excellent coercive force can be obtained. As regards magnetic flux density, however, the addition of chromium has the disadvantage of bringing about a lower magnetic flux density, as is typically shown by Hei 2-259047. The above proposal specifies a minimum magnetic flux density of 11,000 G.

The formation of an oxide film on the surface of a steel material is known from, for example, Japanese Patent Application laid open under No. Hei 1-283343. These arts are, however, not intended for improving the corrosion resistance of the material, but are intended for improving its core-loss property as one of the aspects of its AC properties, or for preventing the formation of any inner oxide layer in the material during its annealing.

As is obvious from the foregoing, the known materials based on iron do not have a satisfactorily low coercive force, though they have a good level of magnetic flux density. Moreover, as there has not been developed any art of manufacturing materials which are resistant to corrosion by themselves, the surface treatment, such as plating or coating, of the materials is necessary for imparting corrosion resistance to them, and adds to the manufacturing cost of components of a magnetic circuit. The known materials based on stainless steel, and having a greatly improved corrosion resistance have the drawback of necessitating the addition of a large amount of chromium which is expensive, and yet brings about an unavoidable lowering in their magnetic flux density.

DISCLOSURE OF THE INVENTION

This invention has been made as a result of extensive study and consideration aimed at the solution of the problems existing in the prior arts as hereinabove pointed out. Its essence resides in the addition of aluminum in a specific range of quantity to iron containing specifically limited proportions of elements as impurities which ensures the growth of ferrite crystals giving an excellent coercive force, and the formation of a corrosion-resistant surface layer of aluminum oxide particles, while the proportions of other alloying elements are also limited so as not to impair the inherently high magnetic flux density of iron. More specifically, the essential features of the invention are as defined below:

(1) A soft magnetic steel material having excellent DC magnetization properties and corrosion resistance, the material containing, on a weight basis, 0.0005 to 0.007% C, 0.0005 to 0.010% of total nitrogen, 0.005 to 0.5% Si, 0.01 to 0.25% Mn, not more than 0.2% P, not more than 0.01% S, 0.8 to 3.5% of soluble aluminum and not more than 0.01% of total oxygen, the balance of its composition being iron and unavoidable impurities, the material having a thickness or diameter of 0.2 mm or more, and an average ferrite crystal diameter d (mm) as defined below in relation to its thickness or diameter t (mm):

$d \geqq 0.2$ if t is from 0.2 mm, inclusive, to less than 0.5 mm, $d \geqq t \times 0.4$ if t is from 0.5 mm, inclusive, to less than 1.3 mm, or $d \geqq 0.5$ if t is 1.3 mm or more, the material having a surface covered densely with aluminum oxide particles having a diameter of 0.01 to 5 microns, the material exhibiting a coercive force not exceeding 0.4 Oe in the absence of any strain and a magnetic flux density of 15,000 G or more at a magnetomotive force of 25 Oe;

(2) A soft magnetic steel material having excellent DC magnetization properties and corrosion resistance, the material containing, on a weight basis, 0.0005 to 0.007% C, 0.0005 to 0.010% of total nitrogen, 0.005 to 0.5% Si, 0.01 to 0.25% Mn, not more than 0.2% P, not more than 0.01% S, 0.8 to 3.5% of soluble aluminum and not more than 0.01% of total oxygen, the balance of its composition being iron and unavoidable impurities, the material having a thickness or diameter of 0.2 mm or more, and an average ferrite crystal diameter d (mm) as defined below in relation to its thickness or diameter t (mm):

$d \geqq 0.2$ if t is from 0.2 mm, inclusive, to less than 0.5 mm, $d \geqq t \times 0.4$ if t is from 0.5 mm, inclusive, to less than 1.3 mm, or $d \geqq 0.5$ if t is 1.3 mm or more, the material having a layer of aluminum oxide particles having a diameter of 0.01 to 5 microns formed on its surface and having a density of $1 \times 10^{12}$ to $1 \times 10^{16}$ particles per square meter, the material exhibiting a coercive force not exceeding 0.4 Oe in the absence of any strain and a magnetic flux density of 15,000 G or more at a magnetomotive force of 25 Oe;

(3) A soft magnetic steel material having excellent DC magnetization properties and corrosion resistance, the material containing, on a weight basis, 0.0005 to 0.007% C, 0.0005 to 0.010% of total nitrogen, 0.005 to 0.5% Si, 0.01 to 0.25% Mn, not more than 0.2% P, not more than 0.01% S, 1.0 to 2.5% of soluble aluminum and not more than 0.01% of total oxygen, the balance of its composition being iron and unavoidable impurities, the material having a thickness or diameter of 0.2 mm or more, and an average ferrite crystal diameter d (mm) as defined below in relation to its thickness or diameter t (mm):

$d \geqq 0.2$ if t is from 0.2 mm, inclusive, to less than 0.5 mm, $d \geqq t \times 0.4$ if t is from 0.5 mm, inclusive, to less than 1.3 mm, or $d \geqq 0.5$ if t is 1.3 mm or more, the material having a layer of aluminum oxide particles having a diameter of 0.01 to 5 microns formed on its surface and having a density of $1 \times 10^{13}$ to $1 \times 10^{16}$ particles per square meter, the material exhibiting a coercive force not exceeding 0.4 Oe in the absence of any strain and a magnetic flux density of 15,000 G or more at a magnetomotive force of 25 Oe;

(4) A method of manufacturing a soft magnetic steel material having excellent DC magnetization properties and corrosion resistance, the material having an average ferrite crystal diameter d (mm) as defined below in relation to its thickness or diameter t (mm):

$d \geqq 0.2$ if t is from 0.2 mm, inclusive, to less than 0.5 mm, $d \geqq t \times 0.4$ if t is from 0.5 mm, inclusive, to less than 1.3 mm, or $d \geqq 0.5$ if t is 1.3 mm or more, the material having a surface covered densely with aluminum oxide particles having a diameter of 0.01 to 5 microns, the material exhibiting a coercive force not exceeding 0.4 Oe in the absence of any strain and a magnetic flux density of 15,000 G or more at a magnetomotive force of 25 Oe, the method comprising heat treating at a temperature of 850° C. to 1300° C. in an atmosphere having an oxygen partial pressure of $10^{-6}$ to $10^{-2}$ atmosphere a steel material containing, on a weight basis, 0.0005 to 0.007% C, 0.0005 to 0.010% of total nitrogen, 0.005 to 0.5% Si, 0.01 to 0.25% Mn, not more than 0.2% P, not more than 0.01% S, 0.8 to 3.5% of soluble aluminum and not more than 0.01% of total oxygen, the balance of its composition being iron and unavoidable impurities, the material having a thickness or diameter of 0.2 mm or more;

(5) A method of manufacturing a soft magnetic steel material having excellent DC magnetization properties and corrosion resistance, the material having an average ferrite crystal diameter d (mm) as defined below in relation to its thickness or diameter t (mm):

$d \geqq 0.2$ if t is from 0.2 mm, inclusive, to less than 0.5 mm, $d \geqq t \times 0.4$ if t is from 0.5 mm, inclusive, to less than 1.3 mm, or $d \geqq 0.5$ if t is 1.3 mm or more, the material having a layer of aluminum oxide particles having a diameter of 0.01 to 5 microns formed on its surface and having a density of $1 \times 10^{12}$ to $1 \times 10^{16}$ particles per square meter, the material exhibiting a coercive force not exceeding 0.4 Oe in the absence of any strain and a magnetic flux density of 15,000 G or more at a magnetomotive force of 25 Oe, the method comprising heat treating at a temperature of 850° C. to 1300° C. in an atmosphere having an oxygen partial pressure of $10^{-6}$ to $10^{-3}$ atmosphere a steel material containing, on a weight basis, 0.0005 to 0.007% C, 0.0005 to 0.010% of total nitrogen, 0.005 to 0.5% Si, 0.01 to 0.25% Mn, not more than 0.2% P, not more than 0.01% S, 0.8 to 3.5% of soluble aluminum and not more than 0.01% of total oxygen, the balance of its composition being iron and unavoidable impurities, the material having a thickness or diameter of 0.2 mm or more; and (6) A method of manufacturing a soft magnetic steel material having excellent DC magnetization properties and corrosion resistance, the material having an average ferrite crystal diameter d (mm) as defined below in relation to its thickness or diameter t (mm):

$d \geqq 0.2$ if t is from 0.2 mm, inclusive, to less than 0.5 mm, $d \geqq t \times 0.4$ if t is from 0.5 mm, inclusive, to less than 1.3 mm, or $d \geqq 0.5$ if t is 1.3 mm or more, the material having a layer of aluminum oxide particles having a diameter of 0.01 to 5 microns formed on its surface and having a density of $1 \times 10^{13}$ to $1 \times 10^{16}$ particles per square meter, the material exhibiting a coercive force not exceeding 0.4 Oe in the absence of any strain and a magnetic flux density of 15,000 G or more at a magnetomotive force of 25 Oe, the method comprising heat treating at a temperature of 850° C. to 1300° C. in an atmosphere having an oxygen partial pressure of $10^{-5}$ to $10^{-3}$ atmosphere a steel material containing, on a weight basis, 0.0005 to 0.007% C, 0.0005 to 0.010% of total nitrogen, 0.005 to 0.5% Si, 0.01 to 0.25% Mn, not more than 0.2% P, not more than 0.01% S, 1.0 to 2.5% of soluble aluminum and not more than 0.01% of total oxygen, the balance of its composition being iron and unavoidable impurities, the material having a thickness or diameter of 0.2 mm or more.

DETAILED DESCRIPTION OF THE INVENTION

The invention will now be described in detail with the reasons for the limitations employed for defining it.

Explanation will first be made of the reasons for the limitations employed for defining the composition of the material according to this invention.

Figure 1:
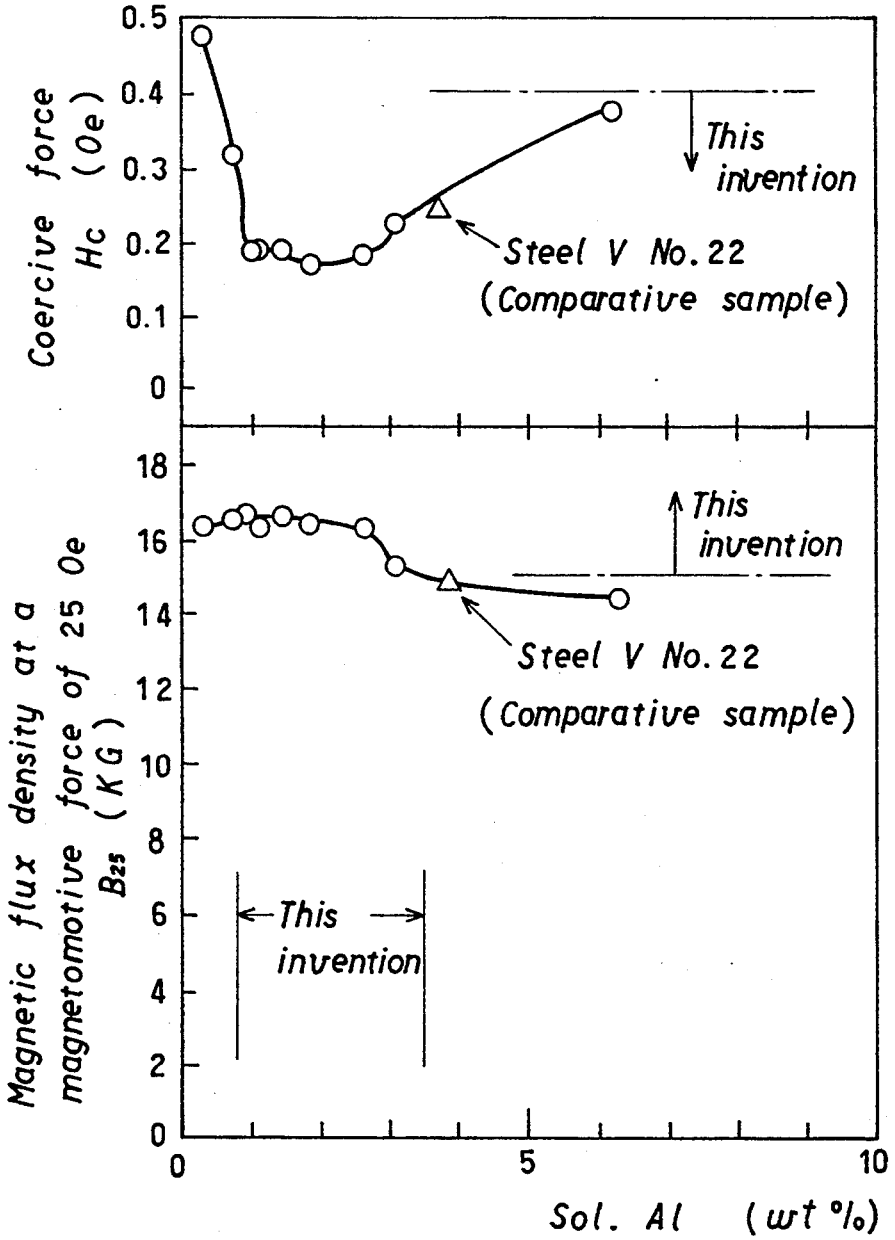
FIG. 1 is a graph showing the coercive force and magnetic flux density ($B_{25}$) of steel materials in relation to their soluble aluminum content.

Al: Aluminum is an essential element for the material of this invention. It fixes nitrogen in a solid solution and forms coherent AlN particles. It raises the transformation temperature and widens the temperature range in which ferrite phase stable. The steel of this invention consists solely of ferrite if it contains 1% or more by weight of soluble aluminum, though its amount varies to some extent with the amounts of elements which the steel contains as impurities. The coarsening of ferrite crystals results in a lower coercive force. Moreover, aluminum is necessary to ensure that a layer of aluminum oxide particles, rather than iron oxide, be formed on a steel surface when steel is annealed in an atmosphere having a specific range of oxygen partial pressure. Therefore, it is necessary to add a specific proportion of aluminum. It is sufficient to add at least 0.5% by weight of soluble aluminum to ensure the realization of a coercive force of 0.4 Oe as shown in FIG. 1, but it is necessary to add at least 0.8%, preferably at least 1.0%, by weight thereof to form a layer of aluminum oxide particles which is sufficiently dense for corrosion resistance. Moreover, it is preferable to add at least 1.0% by weight of soluble aluminum to ensure that steel consist solely of ferrite and show a good coercive force. Thus, the steel of this invention contains at least 0.8%, preferably at least 1.0%, by weight of soluble aluminum.

Although the addition of a large amount of soluble aluminum is desirable for forming a satisfactorily dense layer of aluminum oxide particles, the addition of too much thereof causes problems in the manufacture of steel (during melting and rolling), resulting in an increase of its manufacturing cost, and also brings about a lower magnetic flux density, as shown in FIG. 1. Thus, the steel of this invention contains 3.5%, preferably 2.5%, by weight of soluble aluminum as a maximum.

Figure 2:
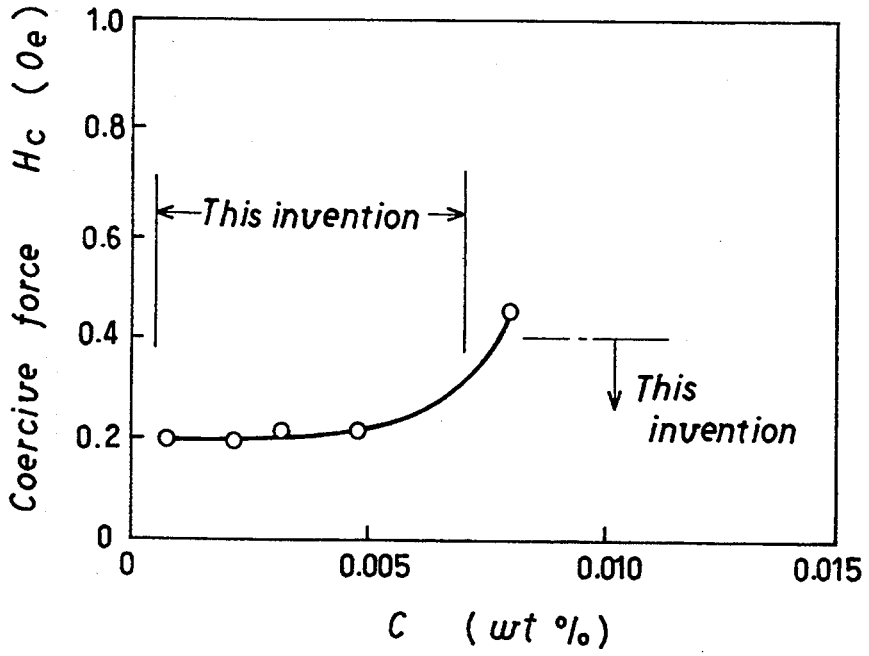
FIG. 2 is a graph showing the coercive force of steel materials in relation to their carbon content.
Figure 3:
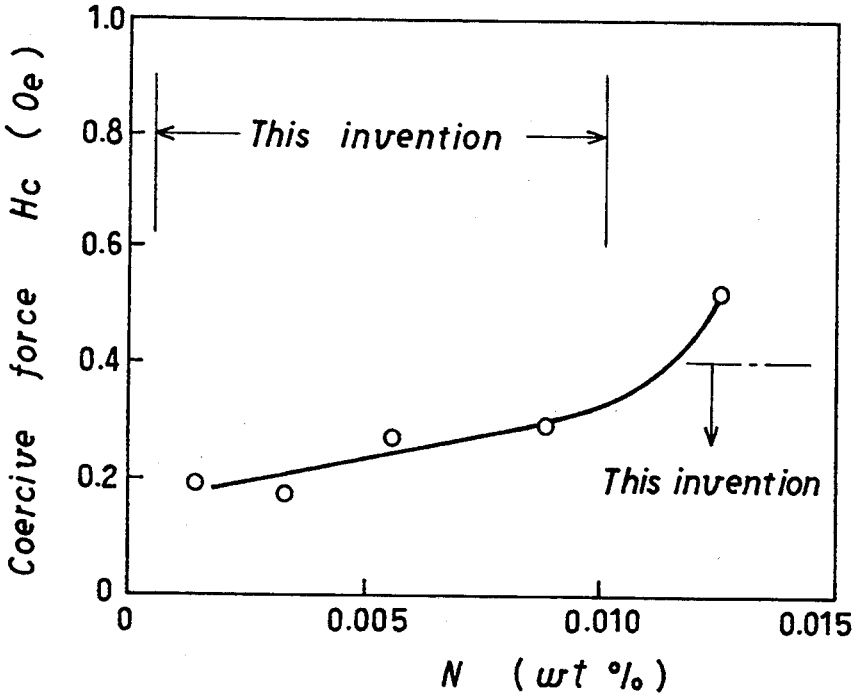
FIG. 3 is a graph showing the coercive force of steel materials in relation to their nitrogen content.

C, N: Carbon and nitrogen are impurities for the material of this invention. It is necessary to limit strictly the amounts of these elements which the material of this invention contains, since they exert a critical influence on the properties of the material. In order to ensure its excellent DC magnetization properties, it is necessary to decrease carbon and total nitrogen as far as possible, but to the extent not bringing about any increase of cost. Both of these elements can be decreased to 0.0005% by weight without bringing about any substantial increase of steelmaking cost. If the proportion of carbon exceeds 0.007% by weight, it greatly lowers the effect by aluminum of widening the range in which ferrite remains stable, and the coersive force of the material is worsened accordingly. If the proportion of nitrogen exceeds 0.010% by weight, an increase of AlN particles prevents the growth of ferrite crystals, and no improved coercive force can be expected. Thus, the material of this invention contains 0.0005 to 0.007% by weight of carbon and 0.0005 to 0.010% by weight of total nitrogen. The effects which carbon and total nitrogen have on the coercive force are shown in FIGS. 2 and 3, respectively.

Si: Silicon has the action of widening the range in which ferrite phase stable, as aluminum does. According to this invention, however, aluminum is employed for that purpose, and it is not necessary to add silicon. The presence of more than 0.5% by weight of silicon brings about not only an increase of cost, but also a lowering of magnetic flux density. The extreme decrease of silicon, however, also brings about an increase of cost. Thus, the material of this invention contains 0.005 to 0.5% by weight of silicon to achieve a good magnetic flux density and a low cost of manufacture.

Mn: It is desirable to decrease manganese, as it is an element which lowers the DC magnetization properties of the steel. Moreover, MnS is likely to lower its corrosion resistance. In this connection, it is desirable to decrease manganese, as well as sulfur. As manganese prevents the hot embrittlement of steel, however, the material of this invention contains manganese in the amount which is not smaller than 10 times its sulfur content, and does not exceed 0.25% by weight. If its sulfur content is lower than 0.001% by weight, however, the minimum proportion of manganese is not decreased to below 0.01% by weight, since any further decrease of manganese brings about an undesirable increase of cost.

P, S, O: Phosphorus, sulfur and oxygen are impurities for the material of this invention. It is necessary to decrease them to the extent not bringing about any increase of cost, so that steel may have excellent DC magnetization properties and retain the basic properties including soundness, reliability and workability. It is, however, possible to add phosphorus to the extent not exceeding 0.2% by weight, if it is necessary to produce a steel sheet or plate having an improved punchability. Thus, the material of this invention contains not more than 0.2% by weight of phosphorus, not more than 0.01% by weight of sulfur and not more than 0.01% by weight of total oxygen.

The material of this invention may contain a larger amount of nitrogen than the upper limit as hereinabove specified, if it contains about 0.001 to 0.02% by weight of a nitride-forming element, such as titanium or boron. It is also possible that the steel of this invention may contain a larger amount of carbon than the upper limit of 0.007% by weight as hereinabove specified, if its subsequent heat treatment is carried out in a decarbonizing atmosphere, such as one containing hydrogen.

Explanation will now be made of the reasons for the limitations employed for defining the features of the steel material according to this invention, other than its composition.

The material of this invention is required to have a thickness or diameter of 0.2 mm or more. If its thickness or diameter is smaller than 0.2 mm, it is difficult to achieve an average ferrite crystal diameter of 0.2 mm or more which is required of the material of this invention, as will hereinafter be described in further detail.

As regards the structure of the steel according to this invention, it consists solely of ferrite. It is required to have an average ferrite crystal diameter d (mm) as defined below in relation to its thickness or diameter t (mm):

$d \geqq 0.2$ if t is from 0.2 mm, inclusive, to less than 0.5 mm, $d \geqq t \times 0.4$ if t is from 0.5 mm, inclusive, to less than 1.3 mm, or $d \geqq 0.5$ if t is 1.3 mm or more.

It is necessary for the average ferrite crystal diameter d to be sufficiently large, depending on the thickness or diameter of the material, to realize a good coercive force. If it satisfies the minimum requirement as specified above in relation to the thickness or diameter of the material, a good coercive force can be obtained. Its failure to satisfy the above requirement results in a coercive force exceeding 0.4 Oe. The minimum value required of the average ferrite crystal diameter d varies with the thickness or diameter of the material, so that a good coercive force may be obtained without being affected by the grain boundary. The coercive force is more likely to be affected by the grain boundary with an increase in thickness or diameter of the material if the crystal diameter remains unchanged. Therefore, it is sufficient for the average ferrite crystal diameter to be relatively small if the thickness or diameter of the material is small, but as its thickness or diameter becomes larger, its average ferrite crystal diameter need be increased to reduce the influence of the grain boundary. A steel material having a thickness or diameter of less than 0.5 mm (but not less than 0.2 mm) exhibits a good coercive force if its average ferrite crystal diameter is 0.2 mm or more. A steel material having a thickness or diameter of 1.3 mm or more suffers from a great influence of the grain boundary and is, therefore, required to have an average ferrite crystal diameter of 0.5 mm or more to reduce the influence of the grain boundary. A steel material having a thickness or diameter of 0.5 mm or more, but less than 1.3 mm exhibits a good coercive force if its average ferrite crystal diameter is equal to, or larger than 0.4 time its thickness or diameter.

To obtain an average ferrite crystal diameter of 0.2 mm or more, it is necessary that 10% or more of ferrite crystals have a diameter of 0.3 mm or more.

The steel material of this invention is also required to have a surface covered densely with aluminum oxide particles having a diameter of 0.01 to 5 microns, preferably forming a layer having a density of $1\times10^{12}$ to $1\times10^{16}$ particles per square meter.

The material of this invention exhibits excellent corrosion resistance if its surface is densely covered with aluminum oxide particles having a diameter of 0.01 to 5 microns, and particularly if those particles form a layer having a density of $1\times10^{12}$ to $1\times10^{16}$ particles per square meter. Still better corrosion resistance can be obtained if those particles form a layer having a density of $1\times10^{13}$ to $1\times10^{16}$ particles per square meter.

In the context of this invention, the aluminum oxide particles may or may not contain iron.

This invention is applicable to any steel material, such as a steel strip (plate or sheet), bar, shape steel, or wire, and a processed product thereof.

Explanation will now be made of the reasons for the limitations employed for defining the method of this invention.

The steel material of this invention is manufactured by finally heat treating a steel material having the composition as hereinabove set forth (or a processed product thereof) at a temperature of 850° C. to 1300° C. in an atmosphere having an oxygen partial pressure of $10^{-6}$ to $10^{-12}$ atmosphere, preferably $10^{-6}$ to $10^{-3}$ atmosphere. The final annealing of the material in the atmosphere having a specifically limited oxygen partial pressure as stated above gives it a satisfactory average ferrite crystal diameter and thereby excellent DC magnetization properties, and also enables the formation on its surface of a dense layer of aluminum oxide particles which is effective for corrosion resistance.

It is not advisable to form a layer of aluminum oxide particles on a steel surface by simply coating it with aluminum oxide particles having an appropriately regulated diameter, since the layer so formed is likely to peel off easily and is not satisfactory in corrosion resistance, either. Moreover, the coating job brings about an unnegligible increase of cost. According to this invention, the layer of aluminum oxide particles can be formed without incurring any additional cost, since it is formed during the annealing which is carried out for imparting soft magnetic property to the material. According to this invention, the aluminum oxide particles are formed by the oxidation, on the steel surface, of a part of aluminum diffused from a solid solution during the heat treatment. Therefore, they adhere very closely to the steel surface. Moreover, they have a high density of distribution and exhibit, therefore, good corrosion resistance.

If the atmosphere employed for the heat treatment has an oxygen partial pressure which is lower than $10^{-6}$ atmosphere, it fails to supply a sufficiently large amount of oxygen for the oxidation of aluminum and makes it impossible to form a satisfactorily dense and corrosion resistant layer of aluminum oxide particles. If its oxygen partial pressure exceeds $10^{-3}$ atmosphere, and particularly $10^{-2}$ atmosphere, the formation of many iron oxide particles alone prior to the formation of aluminum oxide particles results in an oxide film which peels off easily and is unsatisfactory in corrosion resistance.

An oxygen partial pressure of $10^{-5}$ to $10^{-3}$ atmosphere is preferred to obtain a steel material covered with a layer of aluminum oxide particles having a density of $1\times10^{13}$ to $1\times10^{16}$ particles per square meter.

The control of the oxygen partial pressure is easy to accomplish by, for example, employing a mixture of an inert gas such as pure argon, and oxygen, or more simply, employing wet hydrogen gas having a dew point controlled to about −50° C. or above, or employing a vacuum atmosphere having a pressure of $10^{-3}$ to 1 torr.

The heat treatment need be carried out at a temperature of at least 850° C. to ensure the attainment of excellent DC magnetization properties and the formation of the desired layer of aluminum oxide particles. A heat-treatment temperature of at least 900° C. is preferred to ensure the reliable attainment of good corrosion resistance and a good coercive force. As regards the soaking time when a heat-treatment temperature of at least 900° C. is employed, it is sufficient to hold the material at that temperature for at least 10 minutes to achieve the intended results of this invention. If a heat-treatment temperature of at least 850° C., but below 900° C., is employed, it is desirable to hold the material at that temperature for at least about 30 minutes. Heat treatment at any temperature over 1300° C. is undesirable, since it causes the deformation of the material (a steel material, or a processed product thereof), or brings about an increase of cost.

The final heat treatment as hereinabove described may be given to a hot or cold rolled material (or a processed product thereof).

This invention makes it possible to provide at a low cost a soft magnetic steel material having excellent DC magnetization properties and corrosion resistance.

EXAMPLES

TABLES 1 to 3 show the chemical composition of steel strips employed as samples of this invention and comparative samples.

Molten steels having the compositions shown in TABLES 1 to 3 were made, and cast into ingots, and the ingots were hot rolled into sheets having a thickness of 5 or 2 mm. Steel sheets having a thickness smaller than 2 mm were made by cold rolling hot rolled steel sheets having a thickness of 2 mm or more. Test specimens in the shape of a ring having an outside diameter of 45 mm and an inside diameter of 33 mm were prepared from those sheets by machining or punching, heat treated (annealed) under the conditions shown in TABLES 4 to 8, and examined for their average ferrite crystal diameter, layer of aluminum oxide particles, and DC magnetization properties.

Test specimens measuring 70 mm by 150 mm were prepared for corrosion resistance tests by cutting from the hot rolled steel sheets after their surfaces had been machined, or from the cold rolled steel sheets as rolled. After the specimens had been annealed under the same conditions as those mentioned above, three kinds of corrosion resistance tests were conducted:

(1) A two-hour salt spray test was conducted to determine as a measure of corrosion resistance whether the percentage by area of the rusted surface portion was less than 10%, or not;

(2) A 32-hour salt spray test was conducted to determine the percentage by area of the rusted surface portion; and (3) A 500-hour humidity exposure test was conducted at 60° C. and 90% RH to determine the percentage by area of the rusted surface portion.

The average ferrite crystal diameter and the density of aluminum oxide particles which were determined are shown in TABLES 4 to 8, and the DC magnetization properties and the results of the corrosion resistance tests in TABLES 9 to 13.

Nos. 1 to 9, 66 and 67 are samples of this invention and comparative samples which were employed for the determination of differences occurring to the DC magnetization properties and corrosion resistance of the materials annealed under the conditions falling within the scope of this invention, and differing from one another mainly in their contents of soluble aluminum. FIG. 1 shows the DC magnetization properties of Samples Nos. 1 to 9 and No. 22 (comparative) in relation to their contents of soluble aluminum. As is obvious therefrom, the materials containing about 0.5% or more by weight of soluble aluminum exhibited a coercive force not exceeding 0.4 Oe, but the materials containing more than 3.5% by weight of soluble aluminum showed a $B_{25}$ value below 15,000 G. As regards corrosion resistance, no satisfactory result could be obtained from the material containing 0.73% by weight of aluminum, such as Sample No. 2, but a good corrosion resistance was achieved by the material containing 0.8% or more by weight thereof, such as No. 66, and a particularly good corrosion resistance by the material containing 0.99% (1.0%) by weight thereof, such as No. 3.

Samples Nos. 2 and 67 had an average ferrite crystal diameter of 3 mm which was sufficiently large, but as these steels contained less than 1.0% by weight of soluble aluminum, they did not have a completely stabilized ferrite phase, but contained many subgrains having a diameter of about 0.3 mm which had been formed during annealing at a temperature of 1100° C. which was higher than the transformation temperature. Therefore, they were somewhat inferior in coercive force to other samples of this invention, such as No. 3.

Sample No. 66 was of the same steel composition with No. 67, but exhibited a good coercive force, as it had been annealed at a temperature of 1000° C. which was not higher than the transformation temperature.

Samples Nos. 10, 18 and 19 are samples of this invention containing about 1% by weight of soluble aluminum, and different amounts of silicon. All of these samples exhibited good DC magnetization properties and corrosion resistance, though a higher silicon content resulted in a lower $B_{25}$ value.

Nos. 11 to 13 are samples of this invention and a comparative sample which were based on Sample No. 4, but contained different amounts of carbon. Nos. 14 to 17 are samples of this invention and a comparative sample which were based on No. 4, but contained different amounts of nitrogen. Samples Nos. 13 and 17 having carbon and nitrogen contents deviating from the scope of this invention showed an undesirably high coercive force, though they were satisfactory in corrosion resistance.

No. 20 is a sample of this invention containing 0.16% by weight of manganese.

Nos. 35 to 37 are samples of this invention which confirmed that the presence of up to 0.2% by weight of phosphorus did not have any adverse effect on corrosion resistance or DC magnetization properties.

Nos. 21 and 22 are samples which were employed for studying the results of addition of both aluminum and silicon. Sample No. 21 falling within the scope of this invention exhibited a $B_{25}$ value which was higher than 15,000 G. On the other hand, Sample No. 22 deviating from the scope of this invention exhibited a $B_{25}$ value which was lower than 15,000 G. Both of them were, however, satisfactory in corrosion resistance owing to the addition of sufficient amounts of aluminum, and their annealing under proper conditions.

No. 23 is a comparative sample which was employed for studying the properties of industrial pure iron in common use as a soft magnetic material for a DC magnetic field. It was comparable to, or even better than the samples of this invention in $B_{25}$ value, but was inferior in coercive force and corrosion resistance.

Nos. 24 to 28 are samples which were all of a sheet of steel D having a thickness of 2 mm, but were annealed at different temperatures. Sample No. 24 was unsatisfactory in coercive force due to the annealing temperature of 800° C., and was unsatisfactory in corrosion resistance, too, since the annealing atmosphere had a low level of oxygen partial pressure (1 to $3\times10^{-6}$ atmosphere), though falling within the range of this invention, and resulted in the failure to form a satisfactory layer of aluminum oxide particles. On the other hand, Samples Nos. 25 to 28 of this invention were satisfactory in both coercive force and corrosion resistance due to the annealing temperatures above 850° C., though they were of the same material with No. 24, and annealed in the same atmosphere.

Nos. 38 to 47 are samples which were employed for determining the effect of the oxygen partial pressure of the annealing atmosphere on corrosion resistance. A layer of aluminum oxide particles which was necessary for satisfactory corrosion resistance was formed in an annealing atmosphere having an oxygen partial pressure of $5\times10^{-6}$ atmosphere or above, while no such layer could be formed in the atmosphere having an oxygen partial pressure of $8\times10^{-7}$ atmosphere.

Nos. 29 to 34, 52 to 54, 64 and 65 are samples of this invention and a comparative sample which were cold rolled sheets of steel D having a thickness of 1, 0.5, 0.35 or 0.2 mm, and annealed at temperatures falling within the range of this invention in different atmospheres. Sample No. 54 was low in corrosion resistance due to the low density of a layer of aluminum oxide particles formed thereon, since it was the only sample that had been annealed in an atmosphere having an oxygen partial pressure deviating from the range of this invention.

Nos. 55 to 57, 58 and 59, 60 and 61, and 62 and 63 are samples of sheets of steels H, C, A and Z, respectively, having a thickness of 0.5 or 0.7 mm, and annealed at temperatures falling within the range of this invention in atmospheres having different oxygen partial pressures. Sample No. 56 failed to exhibit satisfactory corrosion resistance for the same reason as what has been stated above in connection with Sample No. 54. Samples Nos. 60 to 63 were inferior in corrosion resistance to the samples of this invention due to the failure to form a satisfactory layer of aluminum oxide particles, since the soluble aluminum contents of the materials were lower than the minimum specified by this invention, though they had been annealed in the atmospheres having oxygen partial pressures falling within the range of this invention.

Samples Nos. 48 to 51 are of soft magnetic high-chromium stainless steel sheets as one of the known materials (comparative samples). The comparative samples containing 9% or more, or preferably 12% or more, by weight of chromium showed an improved corrosion resistance, but Samples Nos. 49 to 51 were unsatisfactory in at least one of their coercive force and $B_{25}$ value. Moreover, these comparative samples are more expensive to manufacture than the samples of this invention, since they contain a large amount of chromium which is expensive.

While Samples Nos. 1 to 28, 35 to 37 and 66 were of hot rolled steel sheets, Samples Nos. 1, 13, 17 and 23 were of the chemical composition deviating from the scope of this invention, and failed to attain an average ferrite crystal diameter of 0.5 mm or more as specified by this invention and therefore a coercive force not exceeding 0.4 Oe as intended by this invention, though they had been annealed under proper conditions. Sample No. 24 failed to attain an average ferrite crystal diameter of 0.5 mm or more and a coercive force not exceeding 0.4 Oe, since it had been annealed at a temperature of 800° C. lower than the lower limit specified by this invention. All the other samples had an average ferrite crystal diameter of 0.5 mm or more as specified by this invention.

While Samples Nos. 29 to 34, 38 to 47 and 52 to 65 were of cold rolled steel sheets, Comparative Samples Nos. 60 to 63 were of the chemical composition deviating from the scope of this invention, and failed to attain an average ferrite crystal diameter falling within the scope of this invention (i.e., 0.2 mm or more if the thickness of the sheet is from 0.2 mm, inclusive, to less than 0.5 mm, or the thickness (mm)×0.4 or more if the thickness is from 0.5 mm, inclusive, to less than 1.3 mm) and a coercive force not exceeding 0.4 Oe as intended by this invention, though they had been annealed under proper conditions.

Although Samples Nos. 38, 39, 54 and 56 fell within the scope of this invention in chemical composition and annealing temperature, they failed to form a satisfactory layer of aluminum oxide particles (the layer formed had only a density of less than $10^{12}$ particles per square meter) and attain satisfactory corrosion resistance, since the annealing atmosphere had an oxygen partial pressure lower than $10^{-6}$ atmosphere. On the other hand, Samples Nos. 4, 8, 10 to 12, 20, 21, 25 to 32, 34 to 36, 40, 41, etc., which had been annealed in an atmosphere having an oxygen partial pressure of $10^{-6}$ atmosphere or above, showed good corrosion resistance owing to the formation of a layer of aluminum oxide particles having a density of $10^{12}$ particles per square meter, or above. Samples Nos. 3, 5 to 7, 14 to 16, 18, 19, 33, 37, 42 to 47, etc., which had been annealed in an atmosphere having an oxygen partial pressure of $10^{-5}$ atmosphere or above, showed particularly good corrosion resistance as confirmed by the results of the 32-hour salt spray and 500-hour humidity exposure tests, owing to the formation of a layer of aluminum oxide particles having a density of $10^{13}$ particles per square meter, or above.

TABLE 1

| Steel | C | Si | Mn | P | S | Sol.Al | T.N | (wt %) T.O |
|---|---|---|---|---|---|---|---|---|
| A | 0.0013 | 0.01 | 0.01 | 0.0007 | 0.0002 | 0.30 | 0.0013 | 0.0020 |
| B | 0.0023 | 0.01 | 0.01 | 0.0010 | 0.0003 | 0.73 | 0.0009 | 0.0020 |
| C | 0.0019 | 0.01 | 0.10 | 0.010 | 0.0004 | 0.99 | 0.0018 | 0.0016 |
| D | 0.0022 | 0.08 | 0.04 | 0.007 | 0.0005 | 1.12 | 0.0015 | 0.0005 |
| E | 0.0021 | 0.01 | 0.01 | 0.001 | 0.0003 | 1.45 | 0.0014 | 0.0012 |
| F | 0.0020 | 0.01 | 0.01 | 0.001 | 0.0003 | 1.85 | 0.0012 | 0.0007 |
| G | 0.0020 | 0.01 | 0.01 | 0.001 | 0.0003 | 2.67 | 0.0011 | 0.0008 |
| H | 0.0015 | 0.01 | 0.01 | 0.0006 | 0.0002 | 3.11 | 0.0010 | 0.0018 |
| I | 0.0010 | 0.01 | 0.01 | 0.001 | 0.0002 | 6.27 | 0.0008 | 0.0020 |
| J | 0.0021 | 0.08 | 0.05 | 0.009 | 0.0006 | 1.07 | 0.0021 | 0.0007 |
| K | 0.0032 | 0.08 | 0.05 | 0.010 | 0.0007 | 1.10 | 0.0023 | 0.0009 |
| L | 0.0048 | 0.08 | 0.05 | 0.009 | 0.0008 | 1.10 | 0.0042 | 0.0009 |
| M | 0.0080 | 0.01 | 0.01 | 0.0009 | 0.0003 | 1.12 | 0.0009 | 0.0008 |

TABLE 2

| Steel | C | Si | Mn | P | S | Sol.Al | T.N | (wt %) T.O |
|---|---|---|---|---|---|---|---|---|
| N | 0.0015 | 0.01 | 0.10 | 0.009 | 0.0005 | 1.10 | 0.0034 | 0.0006 |
| O | 0.0012 | 0.01 | 0.10 | 0.009 | 0.0005 | 1.12 | 0.0056 | 0.0009 |
| P | 0.0012 | 0.01 | 0.10 | 0.009 | 0.0004 | 1.11 | 0.0089 | 0.0011 |
| Q | 0.0018 | 0.01 | 0.02 | 0.0013 | 0.0004 | 1.13 | 0.0126 | 0.0016 |
| R | 0.0008 | 0.17 | 0.01 | 0.0005 | 0.0002 | 1.23 | 0.0014 | 0.0010 |
| S | 0.0013 | 0.49 | 0.01 | 0.0004 | 0.0004 | 1.23 | 0.0014 | 0.0012 |
| T | 0.0008 | 0.01 | 0.16 | 0.0003 | 0.0003 | 1.22 | 0.0012 | 0.0008 |
| U | 0.0036 | 0.49 | 0.03 | 0.0017 | 0.0002 | 2.43 | 0.0007 | 0.0009 |
| V | 0.0023 | 0.74 | 0.04 | 0.0021 | 0.001 | 3.73 | 0.0012 | 0.0003 |
| W | 0.0029 | 0.06 | 0.08 | 0.074 | 0.0003 | 1.01 | 0.0004 | 0.0007 |
| X | 0.0022 | 0.01 | 0.03 | 0.105 | 0.0001 | 1.24 | 0.0010 | 0.0021 |
| Y | 0.0029 | 0.02 | 0.03 | 0.200 | 0.0003 | 1.29 | 0.0012 | 0.0029 |

TABLE 2-continued

| Steel | C | Si | Mn | P | S | Sol.Al | T.N | (wt %) T.O |
|---|---|---|---|---|---|---|---|---|
| Z | 0.0016 | 0.01 | 0.06 | 0.009 | 0.0035 | 0.01 | 0.0038 | 0.0031 |

TABLE 3

| Steel | C | Si | Mn | P | S | Sol.Al | Cr | T.N | (wt %) T.O |
|---|---|---|---|---|---|---|---|---|---|
| AA | 0.0020 | 0.01 | 0.07 | 0.001 | 0.0004 | 0.83 | — | 0.0011 | 0.0011 |
| AB | 0.0019 | 0.02 | 0.01 | 0.001 | 0.0005 | 0.03 | 6.09 | 0.0015 | 0.0054 |
| AC | 0.0021 | 0.02 | 0.01 | 0.001 | 0.0005 | 0.03 | 9.04 | 0.0015 | 0.0047 |
| AD | 0.0025 | 0.02 | 0.01 | 0.001 | 0.0005 | 0.03 | 12.0 | 0.0016 | 0.0078 |
| AE | 0.0021 | 0.02 | 0.01 | 0.001 | 0.0006 | 0.03 | 15.1 | 0.0015 | 0.0046 |

TABLE 4

| No. | Steel | Thickness (mm) | Annealing conditions: Atmosphere | Oxygen partial pressure (atm.) | Temperature (°C.) | Average felite crystal diameter (mm) | Density of distribution of aluminum oxide particles (per/m$^2$) | Sample |
|---|---|---|---|---|---|---|---|---|
| 1 | A | 5 | g | $3 \times 10^{-4}$ | 1000 | 0.1 | $1 \sim 9 \times 10^{11}$ | Comparative Example |
| 2 | B | 5 | f | $1 \sim 3 \times 10^{-6}$ | 1100 | 3 | $1 \sim 9 \times 10^{11}$ | Comparative Example |
| 3 | C | 5 | g | $3 \times 10^{-4}$ | 1050 | 2.5 | $1 \sim 9 \times 10^{14}$ | Invention |
| 4 | D | 5 | f | $1 \sim 3 \times 10^{-6}$ | 950 | 1 | $1 \sim 9 \times 10^{13}$ | Invention |
| 5 | E | 5 | g | $3 \times 10^{-4}$ | 1050 | 3 | $1 \sim 9 \times 10^{14}$ | Invention |
| 6 | F | 5 | g | $3 \times 10^{-4}$ | 1050 | 3.5 | $1 \sim 9 \times 10^{14}$ | Invention |
| 7 | G | 5 | g | $3 \times 10^{-4}$ | 1050 | 3 | $1 \sim 9 \times 10^{14}$ | Invention |
| 8 | H | 5 | f | $1 \sim 3 \times 10^{-6}$ | 1100 | 3 | $1 \sim 9 \times 10^{14}$ | Invention |
| 9 | I | 5 | f | $1 \sim 3 \times 10^{-6}$ | 1100 | 2.5 | $1 \sim 9 \times 10^{14}$ | Comparative Example |
| 10 | J | 5 | f | $1 \sim 3 \times 10^{-6}$ | 1050 | 3 | $1 \sim 9 \times 10^{13}$ | Invention |
| 11 | K | 5 | f | $1 \sim 3 \times 10^{-6}$ | 1050 | 1.5 | $1 \sim 9 \times 10^{13}$ | Invention |
| 12 | L | 5 | f | $1 \sim 3 \times 10^{-6}$ | 1050 | 1 | $1 \sim 9 \times 10^{13}$ | Invention |
| 13 | M | 5 | f | $1 \sim 3 \times 10^{-6}$ | 1100 | 0.4 | $1 \sim 9 \times 10^{13}$ | Comparative Example |
| 14 | N | 5 | g | $3 \times 10^{-4}$ | 1050 | 2 | $1 \sim 9 \times 10^{14}$ | Invention |

Annealing atmosphere
a: Ar + 0.8 ppm $O_2$
b: Ar + 5.2 *ppm O2*
c: Ar + 10.6 *ppm O2*
d: Ar + 30.2 *ppm O2*
e: Ar + 99.1 *ppm O2*
f: Vacuum having a pressure of $10^{-3}$ torr
g: Hydrogen (dew point: −20° C. or above)
h: Hydrogen (dew point: −40° C. or above)
i: Ar + 1000 ppm $O_2$
j: Vacuum having a pressure of $10^{-5}$ torr
k: Hydrogen (dew point: −65° C. or above)

TABLE 5

| No. | Steel | Thickness (mm) | Annealing conditions: Atmosphere | Oxygen partial pressure (atm.) | Temperature (°C.) | Average ferrite crystal diameter (mm) | Density of distribution of aluminum oxide particles (per/m$^2$) | Sample |
|---|---|---|---|---|---|---|---|---|
| 15 | O | 5 | g | $3 \times 10^{-4}$ | 1050 | 1 | $1 \sim 9 \times 10^{14}$ | Invention |
| 16 | P | 5 | g | $3 \times 10^{-4}$ | 1050 | 1 | $1 \sim 9 \times 10^{14}$ | Invention |
| 17 | Q | 5 | f | $1 \sim 3 \times 10^{-6}$ | 1100 | 0.4 | $1 \sim 9 \times 10^{13}$ | Comparative Example |
| 18 | R | 5 | g | $3 \times 10^{-4}$ | 1100 | 3 | $1 \sim 9 \times 10^{14}$ | Invention |
| 19 | S | 5 | g | $3 \times 10^{-4}$ | 1100 | 3.5 | $1 \sim 9 \times 10^{14}$ | Invention |
| 20 | T | 5 | f | $1 \sim 3 \times 10^{-6}$ | 1050 | 3.5 | $1 \sim 9 \times 10^{13}$ | Invention |
| 21 | U | 5 | f | $1 \sim 3 \times 10^{-6}$ | 1000 | 1.5 | $1 \sim 9 \times 10^{14}$ | Invention |
| 22 | V | 5 | g | $3 \times 10^{-4}$ | 950 | 1 | $1 \sim 9 \times 10^{14}$ | Comparative Example |
| 23 | Z | 5 | g | $3 \times 10^{-4}$ | 1100 | 0.2 | $1 \sim 9 \times 10^{11}$ | Comparative Example |
| 24 | D | 2 | f | $1 \sim 3 \times 10^{-6}$ | 800 | 0.1 | $1 \sim 9 \times 10^{11}$ | Comparative Example |
| 25 | D | 2 | f | $1 \sim 3 \times 10^{-6}$ | 950 | 0.7 | $1 \sim 9 \times 10^{13}$ | Invention |
| 26 | D | 2 | f | $1 \sim 3 \times 10^{-6}$ | 1000 | 1 | $1 \sim 9 \times 10^{13}$ | Invention |
| 27 | D | 2 | f | $1 \sim 3 \times 10^{-6}$ | 1050 | 1.5 | $1 \sim 9 \times 10^{13}$ | Invention |

TABLE 5-continued

| No. | Steel | Thickness (mm) | Annealing conditions: Atmosphere | Oxygen partial pressure (atm.) | Temperature (°C.) | Average ferrite crystal diameter (mm) | Density of distribution of aluminum oxide particles (per/m$^2$) | Sample |
|---|---|---|---|---|---|---|---|---|
| 28 | D | 2 | f | $1 \sim 3 \times 10^{-6}$ | 1100 | 2 | $1 \sim 9 \times 10^{13}$ | Invention |

Annealing atmosphere
a: Ar + 0.8 ppm $O_2$
b: Ar + 5.2 ppm $O_2$
c: Ar + 10.6 ppm $O_2$
d: Ar + 30.2 ppm $O_2$
e: Ar + 99.1 ppm $O_2$
f: Vacuum having a pressure of $10^{-3}$ torr
g: Hydrogen (dew point: −20° C. or above)
h: Hydrogen (dew point: −40° C. or above)
i: Ar + 1000 ppm $O_2$
j: Vacuum having a pressure of $10^{-5}$ torr
k: Hydrogen (dew point: −65° C. or above)

TABLE 6

| No. | Steel | Thickness (mm) | Annealing conditions: Atmosphere | Oxygen partial pressure (atm.) | Temperature (°C.) | Average ferrite crystal diameter (mm) | Density of distribution of aluminum oxide particles (per/m$^2$) | Sample |
|---|---|---|---|---|---|---|---|---|
| 29 | D | 1 | f | $1 \sim 3 \times 10^{-6}$ | 850 | 0.4 | $1 \sim 9 \times 10^{13}$ | Invention |
| 30 | D | 1 | f | $1 \sim 3 \times 10^{-6}$ | 1050 | 1 | $1 \sim 9 \times 10^{13}$ | Invention |
| 31 | D | 0.5 | f | $1 \sim 3 \times 10^{-6}$ | 1050 | 0.4 | $1 \sim 9 \times 10^{13}$ | Invention |
| 32 | D | 0.35 | f | $1 \sim 3 \times 10^{-6}$ | 850 | 0.2 | $1 \sim 9 \times 10^{13}$ | Invention |
| 33 | D | 0.35 | g | $3 \times 10^{-4}$ | 1050 | 0.3 | $1 \sim 9 \times 10^{14}$ | Invention |
| 34 | D | 0.2 | f | $1 \sim 3 \times 10^{-6}$ | 1000 | 0.2 | $1 \sim 9 \times 10^{13}$ | Invention |
| 35 | W | 5 | f | $1 \sim 3 \times 10^{-6}$ | 1050 | 3 | $1 \sim 9 \times 10^{13}$ | Invention |
| 36 | X | 5 | f | $1 \sim 3 \times 10^{-6}$ | 1050 | 2.5 | $1 \sim 9 \times 10^{13}$ | Invention |
| 37 | Y | 5 | g | $3 \times 10^{-4}$ | 1100 | 4 | $1 \sim 9 \times 10^{14}$ | Invention |
| 38 | D | 0.7 | a | $8 \times 10^{-7}$ | 1000 | 0.7 | $1 \sim 9 \times 10^{11}$ | Comparative Example |
| 39 | U | 0.5 | a | $8 \times 10^{-7}$ | 1000 | 0.4 | $1 \sim 9 \times 10^{11}$ | Comparative Example |
| 40 | D | 0.7 | b | $5 \times 10^{-6}$ | 1000 | 0.6 | $1 \sim 9 \times 10^{13}$ | Invention |
| 41 | U | 0.5 | b | $5 \times 10^{-6}$ | 1000 | 0.5 | $1 \sim 9 \times 10^{13}$ | Invention |
| 42 | D | 0.7 | c | $1 \times 10^{-5}$ | 1000 | 0.6 | $1 \sim 9 \times 10^{13}$ | Invention |

Annealing atmosphere
a: Ar + 0.8 ppm $O_2$
b: Ar + 5.2 ppm $O_2$
c: Ar + 10.6 ppm $O_2$
d: Ar + 30.2 ppm $O_2$
e: Ar + 99.1 ppm $O_2$
f: Vacuum having a pressure of $10^{-3}$ torr
g: Hydrogen (dew point: −20° C. or above)
h: Hydrogen (dew point: −40° C. or above)
i: Ar + 1000 ppm $O_2$
j: Vacuum having a pressure of $10^{-5}$ torr
k: Hydrogen (dew point: −65° C. or above)

TABLE 7

| No. | Steel | Thickness (mm) | Annealing conditions: Atmosphere | Oxygen partial pressure (atm.) | Temperature (°C.) | Average ferrite crystal diameter (mm) | Density of distribution of aluminum oxide particles (per/m$^2$) | Sample |
|---|---|---|---|---|---|---|---|---|
| 43 | U | 0.5 | c | $1 \times 10^{-5}$ | 1000 | 0.5 | $1 \sim 9 \times 10^{13}$ | Invention |
| 44 | D | 0.7 | d | $3 \times 10^{-5}$ | 1000 | 0.7 | $1 \sim 9 \times 10^{14}$ | Invention |
| 45 | U | 0.5 | d | $3 \times 10^{-5}$ | 1000 | 0.4 | $1 \sim 9 \times 10^{14}$ | Invention |
| 46 | D | 0.7 | e | $1 \times 10^{-4}$ | 1000 | 0.6 | $1 \sim 9 \times 10^{14}$ | Invention |
| 47 | U | 0.5 | e | $1 \times 10^{-4}$ | 1000 | 0.4 | $1 \sim 9 \times 10^{14}$ | Invention |
| 48 | AB | 2 | f | $1 \sim 3 \times 10^{-6}$ | 1050 | 0.3 | — | Comparative Example |
| 49 | AC | 2 | f | $1 \sim 3 \times 10^{-6}$ | 1050 | 0.3 | — | Comparative Example |
| 50 | AD | 2 | f | $1 \sim 3 \times 10^{-6}$ | 1050 | 0.6 | — | Comparative Example |
| 51 | AE | 2 | f | $1 \sim 3 \times 10^{-6}$ | 1050 | 2 | — | Comparative Example |
| 52 | D | 0.5 | h | $3 \times 10^{-5}$ | 1000 | 0.5 | $1 \sim 9 \times 10^{13}$ | Invention |
| 53 | D | 0.5 | i | $1 \times 10^{-3}$ | 950 | 0.4 | $1 \sim 9 \times 10^{14}$ | Invention |
| 54 | D | 0.5 | j | $1 \sim 3 \times 10^{-8}$ | 1000 | 0.5 | $1 \sim 9 \times 10^{11}$ | Comparative Example |
| 55 | H | 0.5 | g | $3 \times 10^{-4}$ | 1000 | 0.4 | $1 \sim 9 \times 10^{14}$ | Invention |

TABLE 7-continued

| No. | Steel | Thickness (mm) | Annealing conditions: Atmosphere | Oxygen partial pressure (atm.) | Temperature (°C.) | Average ferrite crystal diameter (mm) | Density of distribution of aluminum oxide particles (per/m$^2$) | Sample |
|---|---|---|---|---|---|---|---|---|
| 56 | H | 0.5 | j | $1 \sim 3 \times 10^{-8}$ | 1000 | 0.5 | $1 \sim 9 \times 10^{11}$ | Comparative Example |

Annealing atmosphere
a: Ar + 0.8 ppm $O_2$
b: Ar + 5.2 ppm $O_2$
c: Ar + 10.6 ppm $O_2$
d: Ar + 30.2 ppm $O_2$
e: Ar + 99.1 ppm $O_2$
f: Vacuum having a pressure of $10^{-3}$ torr
g: Hydrogen (dew point: −20° C. or above)
h: Hydrogen (dew point: −40° C. or above)
i: Ar + 1000 ppm $O_2$
j: Vacuum having a pressure of $10^{-5}$ torr
k: Hydrogen (dew point: −65° C. or above)

TABLE 8

| No. | Steel | Thickness (mm) | Annealing conditions: Atmosphere | Oxygen partial pressure (atm.) | Temperature (°C.) | Average ferrite crystal diameter (mm) | Density of distribution of aluminum oxide particles (per/m$^2$) | Sample |
|---|---|---|---|---|---|---|---|---|
| 57 | H | 0.5 | k | $1 \times 10^{-6}$ | 1000 | 0.5 | $1 \sim 9 \times 10^{14}$ | Invention |
| 58 | C | 0.5 | c | $1 \times 10^{-5}$ | 1000 | 0.5 | $1 \sim 9 \times 10^{13}$ | Invention |
| 59 | C | 0.5 | g | $3 \times 10^{-4}$ | 950 | 0.4 | $1 \sim 9 \times 10^{14}$ | Invention |
| 60 | A | 0.5 | g | $3 \times 10^{-4}$ | 1000 | 0.1 | $1 \sim 9 \times 10^{11}$ | Comparative Example |
| 61 | A | 0.5 | h | $3 \times 10^{-5}$ | 1000 | 0.1 | $1 \sim 9 \times 10^{11}$ | Comparative Example |
| 62 | Z | 0.7 | g | $3 \times 10^{-4}$ | 1000 | 0.1 | $1 \sim 9 \times 10^{11}$ | Comparative Example |
| 63 | Z | 0.7 | h | $3 \times 10^{-5}$ | 1000 | 0.2 | $1 \sim 9 \times 10^{11}$ | Comparative Example |
| 64 | D | 0.5 | e | $1 \times 10^{-4}$ | 900 | 0.4 | $1 \sim 9 \times 10^{13}$ | Invention |
| 65 | D | 0.5 | e | $1 \times 10^{-4}$ | 1050 | 0.5 | $1 \sim 9 \times 10^{14}$ | Invention |
| 66 | AA | 5 | c | $3 \times 10^{-5}$ | 1000 | 2.5 | $1 \sim 9 \times 10^{13}$ | Invention |
| 67 | AA | 5 | c | $3 \times 10^{-5}$ | 1100 | 3 | $1 \sim 9 \times 10^{13}$ | Invention |

Annealing atmosphere
a: Ar + 0.8 ppm $O_2$
b: Ar + 5.2 ppm $O_2$
c: Ar + 10.6 ppm $O_2$
d: Ar + 30.2 ppm $O_2$
e: Ar + 99.1 ppm $O_2$
f: Vacuum having a pressure of $10^{-3}$ torr
g: Hydrogen (dew point: −20° C. or above)
h: Hydrogen (dew point: −40° C. or above)
i: Ar + 1000 ppm $O_2$
j: Vacuum having a pressure of $10^{-5}$ torr
k: Hydrogen (dew point: −65° C. or above)

TABLE 9

| No. | DC magnetization properties: Hc(Oe) | $B_{25}$(G) | Corrosion resistance: Salt spray test (2 hrs)*1 | Salt spray test (32 hrs)*2 | Humidity exposure test (60° C. × 90%, 500 hrs)*2 | Sample |
|---|---|---|---|---|---|---|
| 1 | 0.47 | 16400 | X | 90 | 50 | Comarative Example |
| 2 | 0.32 | 16500 | X | 80 | 70 | Comarative Example |
| 3 | 0.19 | 16700 | ○ | 10 | 0 | Invention |
| 4 | 0.19 | 16300 | ○ | 30 | 15 | Invention |
| 5 | 0.19 | 16600 | ○ | 10 | 0 | Invention |
| 6 | 0.17 | 16400 | ○ | 5 | 0 | Invention |
| 7 | 0.18 | 16200 | ○ | 5 | 0 | Invention |
| 8 | 0.22 | 15200 | ○ | 30 | 10 | Invention |
| 9 | 0.37 | 14400 | ○ | 15 | 5 | Comarative Example |
| 10 | 0.21 | 16900 | ○ | 30 | 15 | Invention |
| 11 | 0.21 | 16900 | ○ | 40 | 15 | Invention |
| 12 | 0.21 | 17000 | ○ | 40 | 20 | Invention |
| 13 | 0.45 | 16700 | ○ | 40 | 15 | Comarative Example |
| 14 | 0.17 | 16300 | ○ | 10 | 0 | Invention |

*1 ○: Rust formed on less than 10% by area of the sample surface;
X: Rust formed on 100% or more by area of the smaple surface
*2: The percentage by area of the rusted sample surface.

TABLE 10

| No. | DC magnetization properties: Hc(Oe) | $B_{25}$(G) | Corrosion resistance: Salt spray test (2 hrs)*1 | Salt spray test (32 hrs)*2 | Humidity exposure test (60° C. × 90%, 500 hrs)*2 | Sample |
|---|---|---|---|---|---|---|
| 15 | 0.27 | 16400 | ○ | 15 | 0 | Invention |

TABLE 10-continued

| No. | DC magnetization properties Hc(Oe) | $B_{25}$(G) | Corrosion resistance: Salt spray test (2 hrs)*1 | Salt spray test (32 hrs)*2 | Humidity exposure test (60° C. × 90%, 500 hrs)*2 | Sample |
|---|---|---|---|---|---|---|
| 16 | 0.29 | 16400 | ○ | 15 | 0 | Invention |
| 17 | 0.51 | 16500 | ○ | 30 | 10 | Comparative Example |
| 18 | 0.19 | 16000 | ○ | 15 | 0 | Invention |
| 19 | 0.17 | 15500 | ○ | 10 | 0 | Invention |
| 20 | 0.16 | 16900 | ○ | 30 | 10 | Invention |
| 21 | 0.23 | 15100 | ○ | 15 | 5 | Invention |
| 22 | 0.24 | 14700 | ○ | 5 | 0 | Comparative Example |
| 23 | 0.69 | 16900 | X | 90 | 70 | Comparative Example |
| 24 | 0.49 | 16500 | X | 70 | 40 | Comparative Example |
| 25 | 0.19 | 16100 | ○ | 40 | 15 | Invention |
| 26 | 0.15 | 16000 | ○ | 40 | 15 | Invention |
| 27 | 0.15 | 15800 | ○ | 30 | 15 | Invention |
| 28 | 0.15 | 15500 | ○ | 40 | 10 | Invention |

*1 ○: Rust formed on less than 10% by area of the sample surface;
X: Rust formed on 100% or more by area of the smaple surface
*2: The percentage by area of the rusted sample surface.

TABLE 11

| No. | DC magnetization properties Hc(Oe) | $B_{25}$(G) | Corrosion resistance: Salt spray test (2 hrs)*1 | Salt spray test (32 hrs)*2 | Humidity exposure test (60° C. × 90%, 500 hrs)*2 | Sample |
|---|---|---|---|---|---|---|
| 29 | 0.32 | 16500 | ○ | 40 | 20 | Invention |
| 30 | 0.17 | 15800 | ○ | 30 | 10 | Invention |
| 31 | 0.21 | 15600 | ○ | 30 | 5 | Invention |
| 32 | 0.36 | 16400 | ○ | 40 | 15 | Invention |
| 33 | 0.22 | 16000 | ○ | 15 | 0 | Invention |
| 34 | 0.31 | 15900 | ○ | 30 | 15 | Invention |
| 35 | 0.17 | 16300 | ○ | 30 | 15 | Invention |
| 36 | 0.19 | 16500 | ○ | 30 | 10 | Invention |
| 37 | 0.15 | 16000 | ○ | 20 | 5 | Invention |
| 38 | 0.21 | 15900 | X | 90 | 50 | Comparative Example |
| 39 | 0.21 | 15200 | X | 70 | 30 | Comparative Example |
| 40 | 0.19 | 15700 | ○ | 40 | 15 | Invention |
| 41 | 0.23 | 15200 | ○ | 40 | 10 | Invention |
| 42 | 0.20 | 15700 | ○ | 40 | 10 | Invention |

*1 ○: Rust formed on less than 10% by area of the sample surface;
X: Rust formed on 100% or more by area of the smaple surface
*2: The percentage by area of the rusted sample surface.

TABLE 12

| No. | DC magnetization properties Hc(Oe) | $B_{25}$(G) | Corrosion resistance: Salt spray test (2 hrs)*1 | Salt spray test (32 hrs)*2 | Humidity exposure test (60° C. × 90%, 500 hrs)*2 | Sample |
|---|---|---|---|---|---|---|
| 43 | 0.23 | 15300 | ○ | 30 | 5 | Invention |
| 44 | 0.19 | 15800 | ○ | 20 | 5 | Invention |
| 45 | 0.24 | 15100 | ○ | 10 | 5 | Invention |
| 46 | 0.18 | 15600 | ○ | 10 | 0 | Invention |
| 47 | 0.21 | 15300 | ○ | 5 | 0 | Invention |
| 48 | 0.95 | 15400 | X | 85 | — | Comparative Example |
| 49 | 1.05 | 14700 | ○ | 80 | — | Comparative Example |
| 50 | 0.50 | 14000 | ○ | 0 | 0 | Comparative Example |
| 51 | 0.20 | 14100 | ○ | 0 | 0 | Comparative Example |
| 52 | 0.21 | 15800 | ○ | 40 | 10 | Invention |
| 53 | 0.22 | 15900 | ○ | 10 | 0 | Invention |
| 54 | 0.20 | 15700 | X | 95 | 70 | Comparative Example |
| 55 | 0.23 | 15100 | ○ | 10 | 0 | Invention |
| 56 | 0.22 | 15000 | X | 95 | 60 | Comparative Example |

*1 ○: Rust formed on less than 10% by area of the sample surface;
X: Rust formed on 100% or more by area of the smaple surface
*2: The percentage by area of the rusted sample surface.

TABLE 13

| No. | DC magnetization properties Hc(Oe) | $B_{25}$(G) | Corrosion resistance: Salt spray test (2 hrs)*1 | Salt spray test (32 hrs)*2 | Humidity exposure test (60° C. × 90%, 500 hrs)*2 | Sample |
|---|---|---|---|---|---|---|
| 57 | 0.22 | 15100 | ○ | 30 | 10 | Invention |
| 58 | 0.19 | 16100 | ○ | 30 | 15 | Invention |
| 59 | 0.21 | 16300 | ○ | 20 | 5 | Invention |
| 60 | 0.45 | 16300 | X | 90 | 50 | Comparative Example |
| 61 | 0.44 | 16400 | X | 90 | 70 | Comparative Example |

TABLE 13-continued

| No. | DC magnetization properties Hc(Oe) | $B_{25}$(G) | Corrosion resistance Salt spray test (2 hrs)*1 | Salt spray test (32 hrs)*2 | Humidity exposure test (60° C. × 90%, 500 hrs)*2 | Sample |
|---|---|---|---|---|---|---|
| 62 | 0.62 | 16500 | X | 90 | 60 | Comparative Example |
| 63 | 0.64 | 16600 | X | 95 | 80 | Comparative Example |
| 64 | 0.20 | 15700 | ○ | 20 | 5 | Invention |
| 65 | 0.19 | 15600 | ○ | 15 | 0 | Invention |
| 66 | 0.20 | 16600 | ○ | 50 | 15 | Invention |
| 67 | 0.33 | 16700 | ○ | 50 | 15 | Invention |

*1 ○: Rust formed on less than 10% by area of the sample surface;
X: Rust formed on 100% or more by area of the smaple surface
*2: The percentage by area of the rusted sample surface.

INDUSTRIAL UTILITY

The soft magnetic steel material of this invention is useful for making, for example, components forming a magnetic circuit.

We claim:

1. A soft magnetic steel material having excellent DC magnetization properties and corrosion resistance, said material consisting essentially of, on a weight basis, 0.0005 to 0.007% C, 0.0005 to 0.010% of total nitrogen, 0.005 to 0.5% Si, 0.01 to 0.25% Mn, not more than 0.2% P, not more than 0.01% S, 0.8 to 3.5% of soluble aluminum and not more than 0.01% of total oxygen, the balance of its composition being iron and unavoidable impurities, said material having a thickness or diameter of 0.2 mm or more, and an average ferrite crystal diameter d (mm) as defined below in relation to its thickness or diameter t (mm):

$d \geqq 0.2$ if t is from 0.2 mm, inclusive, to less than 0.5 mm, $d \geqq t \times 0.4$ if t is from 0.5 mm, inclusive, to less than 1.3 mm, or $d \geqq 0.5$ if t is 1.3 mm or more, said material having a surface covered densely with aluminum oxide particles having a diameter of 0.01 to 5 microns, said material exhibiting a coercive force not exceeding 0.4 Oe in the absence of any strain and a magnetic flux density of 15,000 G or more at a magnetomotive force of 25 Oe.

2. A soft magnetic steel material having excellent DC magnetization properties and corrosion resistance, said material consisting essentially of, on a weight basis, 0.0005 to 0.007% C, 0.0005 to 0.010% of total nitrogen, 0.005 to 0.5% Si, 0.01 to 0.25% Mn, not more than 0.2% P, not more than 0.01% S, 0.8 to 3.5% of soluble aluminum and not more than 0.01% of total oxygen, the balance of its composition being iron and unavoidable impurities, said material having a thickness or diameter of 0.2 mm or more, and an average ferrite crystal diameter d (mm) as defined below in relation to its thickness or diameter t (mm):

$d \geqq 0.2$ if t is from 0.2 mm, inclusive, to less than 0.5 mm, $d \geqq t \times 0.4$ if t is from 0.5 mm, inclusive, to less than 1.3 mm, or $d \geqq 0.5$ if t is 1.3 mm or more, said material having a layer of aluminum oxide particles having a diameter of 0.01 to 5 microns formed on its surface and having a density of $1 \times 10^{12}$ to $1 \times 10^{16}$ particles per square meter, said material exhibiting a coercive force not exceeding 0.4 Oe in the absence of any strain and a magnetic flux density of 15,000 G or more at a magnetomotive force of 25 Oe.

3. A soft magnetic steel material having excellent DC magnetization properties and corrosion resistance, said material consisting essentially of, on a weight basis, 0.0005 to 0.007% C, 0.0005 to 0.010% of total nitrogen, 0.005 to 0.5% Si, 0.01 to 0.25% Mn, not more than 0.2% P, not more than 0.01% S, 1.0 to 2.5% of soluble aluminum and not more than 0.01% of total oxygen, the balance of its composition being iron and unavoidable impurities, said material having a thickness or diameter of 0.2 mm or more, and an average ferrite crystal diameter d (mm) as defined below in relation to its thickness or diameter t (mm):

$d \geqq 0.2$ if t is from 0.2 mm, inclusive, to less than 0.5 mm, $d \geqq t \times 0.4$ if t is from 0.5 mm, inclusive, to less than 1.3 mm, or $d \geqq 0.5$ if t is 1.3 mm or more, said material having a layer of aluminum oxide particles having a diameter of 0.01 to 5 microns formed on its surface and having a density of $1 \times 10^{13}$ to $1 \times 10^{16}$ particles per square meter, said material exhibiting a coercive force not exceeding 0.4 Oe in the absence of any strain and a magnetic flux density of 15,000 G or more at a magnetomotive force of 25 Oe.

4. A method of manufacturing a soft magnetic steel material having excellent DC magnetization properties and corrosion resistance, said method comprising heat treating a steel material consisting essentially of, on a weight basis, 0.0005 to 0.007% C, 0.0005 to 0.010% of total nitrogen, 0.005 to 0.5% Si, 0.01 to 0.25% Mn, not more than 0.2% P, not more than 0.01% S, 0.8 to 3.5% of soluble aluminum and not more than 0.01% of total oxygen, the balance of its composition being iron and unavoidable impurities, said material having a thickness or diameter of 0.2 mm or more at a temperature of 850° C. to 1300° C. in an atmosphere having an oxygen partial pressure of $10^{-6}$ to $10^{-2}$ atmosphere to provide a heat treated soft magnetic steel material, said heat treated material having an average ferrite crystal diameter d (mm) as defined below in relation to its thickness or diameter t (mm):

$d \geqq 0.2$ if t is from 0.2 mm, inclusive, to less than 0.5 mm, $d \geqq t \times 0.4$ if t is from 0.5 mm, inclusive, to less than 1.3 mm, or $d \geqq 0.5$ if t is 1.3 mm or more, said heat treated material having a surface covered densely with aluminum oxide particles having a diameter of 0.01 to 5 microns, said heat treated material exhibiting a coercive force not exceeding 0.4 Oe in the absence of any strain and a magnetic flux density of 15,000 G or more at a magnetomotive force of 25 Oe.

5. A method of manufacturing a soft magnetic steel material having excellent DC magnetization properties and corrosion resistance, said method comprising heat treating a steel material consisting essentially of, on a weight basis, 0.0005 to 0.007% C, 0.0005 to 0.010% of total nitrogen, 0.005 to 0.5% Si, 0.01 to 0.25% Mn, not more than 0.2% P, not more than 0.01% S, 0.8 to 3.5% of soluble aluminum and not more than 0.01% of total oxygen, the balance of its composition being iron and unavoidable impurities, said material having a thickness or diameter of 0.2 mm or more at a temperature of 850° C. to 1300° C. in an atmosphere having an oxygen partial pressure of $10^{-6}$ to $10^{-3}$ atmosphere to provide a heat treated soft magnetic steel material, said heat treated material having an average ferrite crystal diameter d (mm) as defined below in relation to its thickness or diameter t (mm):

$d \geqq 0.2$ if t is from 0.2 mm, inclusive, to less than 0.5 mm, $d \geqq t \times 0.4$ if t is from 0.5 mm, inclusive, to less than 1.3 mm, or $d \geqq 0.5$ if t is 1.3 mm or more, said heat treated material having a layer of aluminum oxide particles having a diameter of 0.01 to 5 microns formed on its surface and having a density of $1 \times 10^{12}$ to $1 \times 10^{16}$ particles per square meter, said heat treated material exhibiting a coercive force not exceeding 0.4 Oe in the absence of any strain and a magnetic flux density of 15,000 G or more at a magnetomotive force of 25 Oe.

6. A method of manufacturing a soft magnetic steel material having excellent DC magnetization properties and corrosion resistance, said method comprising heat treating a steel material consisting essentially of, on a weight basis, 0.0005 to 0.007% C, 0.0005 to 0.010% of total nitrogen, 0.005 to 0.5% Si, 0.01 to 0.25% Mn, not more than 0.2% P, not more than 0.Q1% S, 1.0 to 2.5% of soluble aluminum and not more than 0.01% of total oxygen, the balance of its composition being iron and unavoidable impurities, said material having a thickness or diameter of 0.2 mm or more at a temperature of 850° C. to 1300° C. in an atmosphere having an oxygen partial pressure of $10^{-5}$ to $10^{-3}$ atmosphere to provide a heat treated soft magnetic steel material, said heat treated material having an average ferrite crystal diameter d (mm) as defined below in relation to its thickness or diameter t (mm):

$d \geqq 0.2$ if t is from 0.2 mm, inclusive, to less than 0.5 mm, $d \geqq t \times 0.4$ if t is from 0.5 mm, inclusive, to less than 1.3 mm, or $d \geqq 0.5$ if t is 1.3 mm or more, said heat treated material having a layer of aluminum oxide particles having a diameter of 0.01 to 5 microns formed on its surface and having a density of $1 \times 10^{13}$ to $1 \times 10^{16}$ particles per square meter, said heat treated material exhibiting a coercive force not exceeding 0.4 Oe in the absence of any strain and a magnetic flux density of 15,000 G or more at a magnetomotive force of 25 Oe.

* * * * *